US012264885B2

(12) United States Patent
Schmidt et al.

(10) Patent No.: US 12,264,885 B2
(45) Date of Patent: Apr. 1, 2025

(54) ANTI-FOULING DEVICE FOR HEAT EXCHANGERS AND ITS USE

(71) Applicant: Orion Engineered Carbons IP GmbH & Co. KG, Monheim (DE)

(72) Inventors: Kay Schmidt, Frankfurt am Main (DE); Arndt-Peter Schinkel, Marienhausen (DE); Vitus Dorfner, Frankfurt am Main (DE)

(73) Assignee: Orion Engineered Carbons IP GmbH & Co. KG, Monheim (DE)

( * ) Notice: Subject to any disclaimer, the term of this patent is extended or adjusted under 35 U.S.C. 154(b) by 275 days.

(21) Appl. No.: 17/639,387

(22) PCT Filed: Sep. 1, 2020

(86) PCT No.: PCT/EP2020/074305

§ 371 (c)(1),
(2) Date: Mar. 1, 2022

(87) PCT Pub. No.: WO2021/043751

PCT Pub. Date: Mar. 11, 2021

(65) Prior Publication Data

US 2022/0333880 A1 Oct. 20, 2022

(30) Foreign Application Priority Data

Sep. 2, 2019 (EP) ..... 19194829

(51) Int. Cl.
*F28F 19/00* (2006.01)
*F28D 7/16* (2006.01)

(52) U.S. Cl.
CPC ..... *F28F 19/002* (2013.01); *F28D 7/1607* (2013.01); *F28F 2240/00* (2013.01); *F28F 2265/00* (2013.01)

(58) Field of Classification Search
CPC ..... F28D 7/16; F28D 7/1607; F28F 19/002; F28F 2240/00; F28F 2265/00
See application file for complete search history.

(56) References Cited

U.S. PATENT DOCUMENTS 2,753,932 A * 7/1956 Eckstrom ..... B01D 3/28 159/13.1
2,949,935 A * 8/1960 Edmouds ..... F16K 3/26 137/589

(Continued)

FOREIGN PATENT DOCUMENTS

CN 101949545 A 1/2011
DE 3045731 A1 7/1982

(Continued)

*Primary Examiner* — Eric S Ruppert
*Assistant Examiner* — Hans R Weiland
(74) *Attorney, Agent, or Firm* — The Webb Law Firm

(57) ABSTRACT

An anti-fouling device includes an elongated displacement body insertable in a heat exchanger tube to reduce the flow cross-sectional area in a portion of the tube. A mount is connected to the elongated displacement body for attaching the device to an end of the heat exchanger tube. The mount is configured to hold the displacement body, when inserted into the tube, in a spaced relationship to the inner surface of the tube. The device reliably reduces fouling over an extended period of time without requiring maintenance or external controls, is easily installable, and can be retrofitted to existing heat exchangers. The device mitigates fouling related issues in heat exchangers subjected to hot combustion or process gases such as those encountered in the production of carbon black, fumed silica or other particulate matter, without contaminating the product recoverable from the process gas or having an adverse influence on the properties thereof.

17 Claims, 5 Drawing Sheets

(56) References Cited

U.S. PATENT DOCUMENTS

| | | | | |
|---|---|---|---|---|
| 4,366,003 | A | 12/1982 | Korte et al. | |
| 4,418,649 | A | 12/1983 | Purvis | |
| 4,735,263 | A * | 4/1988 | Andro | F28F 19/002 122/406.3 |
| 4,825,940 | A | 5/1989 | Barroyer et al. | |
| 4,846,894 | A | 7/1989 | Clem et al. | |
| 4,848,447 | A * | 7/1989 | Sladky | F28D 3/04 165/DIG. 170 |
| 4,993,479 | A | 2/1991 | Jekerle | |
| 6,585,949 | B1 | 7/2003 | Green et al. | |
| 6,960,333 | B2 | 11/2005 | Blanda, Jr. et al. | |
| 10,006,719 | B2 * | 6/2018 | Telgen | F28F 9/0229 |
| 2001/0040024 | A1 * | 11/2001 | Blanda, Jr. | F28F 19/002 165/178 |
| 2004/0096378 | A1 * | 5/2004 | Te Raa | C07D 301/10 422/211 |
| 2006/0075976 | A1 | 4/2006 | Boll et al. | |
| 2012/0073483 | A1 * | 3/2012 | Ojanpera | F28F 19/002 110/302 |
| 2014/0338254 | A1 | 11/2014 | Feustel et al. | |
| 2014/0345828 | A1 | 11/2014 | Ehmann et al. | |
| 2017/0073483 | A1 | 3/2017 | Ducros et al. | |
| 2021/0003355 | A1 * | 1/2021 | Manenti | F28D 7/16 |

FOREIGN PATENT DOCUMENTS

| | | | |
|---|---|---|---|
| EP | 0777098 | A2 * | 6/1997 |
| EP | 1065467 | A2 | 1/2001 |
| EP | 2881691 | A1 | 6/2015 |
| EP | 2820366 | B1 | 9/2016 |
| EP | 3438562 | A1 | 2/2019 |
| EP | 3499171 | A1 | 6/2019 |
| JP | H02136694 | A | 5/1990 |
| JP | 2000507690 | A | 6/2000 |
| WO | 9737189 | A1 | 10/1997 |
| WO | 9817961 | A1 | 4/1998 |
| WO | 2010139852 | A1 | 12/2010 |
| WO | 2014099601 | A1 | 6/2014 |
| WO | 2017085944 | A1 | 5/2017 |

* cited by examiner (II-II)

(IIa-IIa)

ANTI-FOULING DEVICE FOR HEAT EXCHANGERS AND ITS USE

CROSS-REFERENCE TO RELATED APPLICATIONS

This application is the United States national phase of International Application No. PCT/EP2020/074305 filed Sep. 1, 2020, and claims priority to European Patent Application No. 19194829.8 filed Sep. 2, 2019, the disclosures of which are hereby incorporated by reference in their entirety.

BACKGROUND OF THE INVENTION

Field of the Invention

The present invention relates to an anti-fouling device and its use for reducing or avoiding fouling in heat exchangers. It is also directed towards heat exchangers incorporating this device and their use in industrial processes, particularly in the production of carbon black.

Description of the Related Art

Heat exchangers find wide-spread use in various industrial processes to recuperate energy from hot process or combustion gases and transfer it to a heat exchanging fluid in order to enhance the overall efficiency of the process. The recuperated energy may for instance be used to heat one or more reactants, which may in this case directly be employed as the heat exchanging fluid, or to contribute to maintaining a required operation or reaction temperature in the process or be used for other purposes including those not directly associated with the process itself such as for generating electricity or district heating. In some of these processes, heat exchangers may be subjected to substantially high temperatures such as 1,000° C. or more imposing stringent requirements on the materials selection. Illustrative examples of such high temperature processes include the production of carbon black or fumed silica.

Carbon black is generally produced by pyrolysis of a hydrocarbonaceous feedstock under controlled conditions. A variety of different methods and reactors for manufacturing carbon black are generally known (cf. for example Jean-Baptiste Donnet, Roop Chand Bansal, Meng-Jiao Wang, Carbon Black, 2nd edition, CRC Press, 1993). According to the most common type of production process, a hydrocarbonaceous feedstock is injected at one or more positions in a furnace reactor into a stream of hot combustion gases that has previously been generated upstream by reacting a fuel, generally a hydrocarbonaceous fuel, with an oxidant, preferably air. Due to the high temperatures in the combustion gases the injected hydrocarbonaceous feedstock thermally decomposes and a formation of carbon black proceeds as the mixture of feedstock and hot combustion gases passes through the reaction zone of the reactor. After a carbon black having the desired properties has been formed the pyrolysis is stopped by quenching the process mixture typically by the injection of water. The obtained carbon black-laden gas is generally passed through a heat exchanger, also referred to as an air pre-heater, for further cooling the carbon black-laden gas and simultaneously preheating air, which is then supplied to the combustion chamber of the reactor for reacting with the fuel to form the hot combustion gases. The cooled carbon black-laden gas is subsequently passed to a filter unit, such as a bag filter, where the carbon black product is separated and collected from the gas stream.

A conventional heat exchanger used in the production of carbon black typically comprises a plurality of parallel tubes extending through a cylindrical vertically arranged chamber enclosed by a cylindrical shaped shell, a bottom plate and a top plate. An inlet and an outlet for air to be preheated is provided to the chamber, typically at a bottom and a top section of the shell. When the hot carbon black-laden gas is passed through the tubes, heat is transferred across the tube walls to the stream of air flowing on the outer surface of the tubes inside of the chamber. The temperature of the air may thereby be increased to a temperature as high as about 950° C. and more at the outlet. Besides others, mostly the heat exchanger is operated in counter current mode, typically with the hot carbon black-laden gas passing through the tubes from the bottom to the top. The heat exchanger frequently comprises additional means such as baffle plates for controlling the flow of air in the chamber.

A common problem encountered with conventional heat exchangers used to recuperate energy from hot process or combustion gases such as those obtained from a reactor for the production of carbon black is that they are prone to fouling under typical operational conditions. Thus, the process or combustion gases typically contain condensed phase matter or precursors thereof. Fouling occurs through a deposition of condensed phase material, e.g. particulate matter such as carbon black, on the heat exchanging surfaces, which come into contact with the hot combustion or process gases that contain condensed phase material, such as in particular the inner surface of heat exchanger tubes. Fouling is commonly an autocatalytic process as already formed deposits may serve as nuclei and facilitate the deposition of additional condensed phase material on the heat exchanging surfaces.

Fouling may have several negative effects. Thus, it adversely affects the efficiency of the heat transfer, for example by reducing the heat transmission coefficient of the heat exchanging surfaces of the heat exchanger. Accordingly, the achievable exit temperature of the heat exchanging fluid like air may be lower, which can reduce the efficiency of a coupled production process, for example leading to lower yields or production rates in the production of carbon black. To some extent such less efficient heat transfer might be compensated by using a higher entrance temperature of the process or combustion gas in order to achieve a desired exit temperature of the heat exchanging fluid, however, this increases on the other hand the thermal stresses imposed on the heat exchanger. As fouling is a gradual process variations in the exit temperature of the heat exchanging fluid may also result in undesirable long-term variations of characteristics of a product obtainable from a coupled production process that utilizes the heat exchanging fluid such as for example the physical properties of a carbon black product. The deposits on the heat exchanging surfaces may furthermore influence the gas flow characteristics in the heat exchanger, for instance they can increase the pressure drop between opposite ends of a heat exchanger tube, which may likewise adversely affect process efficiency and create additional stresses on the heat exchanger materials. Ultimately, there is the risk that fouling may lead to a complete clogging of a heat exchanger tube and/or cause irreversible damage to the heat exchanger such as by cracking or rupture of a heat exchanger tube. Moreover, the deposits tend to harden and embrittle over time such that there is a risk that hardened deposits may detach from the heat exchanger surface and re-enter the stream of process or combustion gases leading to a contamination of products obtainable therefrom.

In order to avoid these problems and disadvantages and to re-establish proper functionality heat exchangers have conventionally been shut down from time to time for regular maintenance to remove the deposits from the heat exchanging surfaces. Cleaning of the heat exchanger tubes, e.g. mechanically such as by means of a long wire brush or by sandblasting, is however labour- and time-consuming and imposes stresses on the heat exchanger materials. Moreover, such approach is expensive as the time required for shutdown and cleaning operations means a loss of production time.

Accordingly, different technical solutions have been developed in the art to counteract fouling of heat exchanger surfaces.

One option foresees recurrent heating of the heat exchanger tubes in an atmosphere having an oxygen level below the lower explosion limit for thermally removing the deposits from the inner surfaces of the heat exchanger tubes. Such thermal cleaning may however impose significant thermal stresses on the heat exchanger, including the risk of local overheating, giving rise to a degradation of the heat exchanger reducing its lifetime.

Also, the use of various chemical additives as antifoulant has been considered. For example, an addition of certain polymeric materials to a hot process or combustion medium potentially causing fouling and/or to precursor materials used for forming such medium has been suggested to avoid fouling on heat exchanger surfaces. For instance, US 2014/0338254 A1 proposes the use of certain hydroxy-functional polyesters as an antifoulant in the thermal treatment of liquid hydrocarbon media in the temperature range from 100 to 550° C. Such antifoulants may help to retard or avoid the progress of fouling, however, they typically cannot remove deposits already formed on heat exchanging surfaces. Alternatively, utilization of sugar-containing cleaning compositions has been foreseen and a removal of deposits from fouled heat exchanger tubes achievable thereby attributed to an abrasive cleaning of the surfaces. The use of chemical additives however generally means the addition of foreign matter into the process medium, which can contaminate or otherwise adversely influence the properties of a product to be obtained from the process medium.

Other approaches therefore seek to minimize fouling by specific constructional designs of the heat exchanger. Herein, it has been found that a large temperature gradient between the process medium and the heat exchanger surface in contact therewith typically promotes fouling and accordingly constructional designs were devised to keep that temperature gradient small.

For example, U.S. Pat. No. 6,585,949 B1 suggests to maintain the temperature difference between a combustion gas containing carbon black and the heat exchanging surfaces in contact therewith to be not greater than 500° F., most preferably not greater than 100° F. in order to inhibit fouling of the heat exchanger surfaces. The temperature difference is controlled herein by controlling the velocity of the stream of the heat exchanging fluid, which is preferably air. For this purpose, it suggests a heat exchanger construction with an outer and an inner shell, wherein the air stream is divided and distributed to different baffle passes by providing holes varying in number and diameter in such a manner that local cooling of any part of the heat exchange surface is minimized.

EP 0 777 098 A2 proposes an alternative specific heat exchanger design that includes a double bottom tube sheet and means to shield the one or more process gas tubes in areas where relatively cold cooling medium would otherwise directly impinge thereon. The shielding means can comprise a gas tube chamber adjacent to a cooling medium inlet port and/or a ferrule disposed circumferentially adjacent the lower portion of the process gas tube within the double bottom tube sheet providing together with a ferrule filler a heat barrier between the hot process gas and the bottom section of the process gas tube. This design shall avoid abrupt localized temperature changes and achieve a more uniform internal temperature gradient thereby reducing fouling tendency inside the process gas tubes.

Furthermore, EP 2 820 366 B1 relates to a heat exchanger adapted for the production of carbon black, which has a two-stage design, wherein the hot process medium containing carbon black, before entering a tubular heat exchanging part, is passed through a vertically arranged chamber being surrounded by a cylindrically shaped shell adapted for allowing heat transfer to a gas to be preheated flowing on the outside of that shell, and the preheated gas is then fed by a conduit to the inlet of the tubular heat exchanger. This preheating is maintained to reduce the temperature difference between the surface of the tubes in the tubular heat exchanging part and the hot process medium containing carbon black flowing inside the tubes thereby reducing or even eliminating fouling of the tubes.

Such specific constructions of the heat exchanger have led to some improvements in reducing fouling, however, at the expense of an increased complexity and sensitivity of the heat exchanger system. Moreover, existing heat exchangers cannot be retrofitted to such concepts as major constructional changes to the heat exchangers would be necessary to adapt them accordingly.

Besides constructional changes to the design of the principal heat exchanger auxiliary apparatuses specifically designed to mitigate fouling in heat exchangers relying on different physical principles have been suggested.

Thus, for instance, devices have been suggested, which rely on cleaning fouled heat exchangers by periodically flushing the tubes during operation of the heat exchanger with short high velocity, e.g. supersonic, gas pulses of a cleaning medium such as superheated steam. An example of such device is disclosed in U.S. Pat. No. 4,366,003 and comprises a series of jet nozzles such as Laval nozzles arranged in a space centrally over the gas inlet openings of the tubes of a heat exchanger and connected to a duct provided with shut-off elements for the periodic feed of a cleaning gas having an excess pressure relative to the process gas. The periodic gas pulses are described to exert a disintegrating effect on the deposits on the inner surface of the heat exchanger tubes by a cavitation effect and enable to keep the pressure drop along the heat exchanger tubes low and to maintain a high heat exchanging efficiency without adversely affecting the quality of a carbon black product.

Similarly, CN 101949545 (A) describes an automatic fouling removing device for heat exchangers of the shell-tube type. The device comprises an air injection tube with multiple air injection ports mounted close to and in parallel to the plane of ends of heat exchanger tubes, a connection to a compressed air source with a valve, a transmission mechanism including a motor for positioning the air injection tube with the air injection ports in different positions adjusted each time to face a group of heat exchanger tube ports, and a controller controlling the relative positioning of the injection tube over the heat exchanger tubes and the injection of high pressure pulses into the heat exchanger tubes to remove deposits from its inner surfaces.

Moreover, U.S. Pat. No. 4,846,894 proposes to interrupt the flow of carbon black particle-carrying transport gas passing through tubes of a heat exchanger intermittently for a short period of time on the order of one second to cause solid deposits having deposited on the inner surface of the tubes to be removed and swept away upon resumption of the gas flow. It also describes a device for implementing such method, which comprises a shutter or flow interrupter assembly with a shutter plate positioned adjacent to a discharge end of the tubes such that the plate may slide into a position to block the discharge end of the tubes.

U.S. Pat. No. 4,825,940 discloses an automatic cleaning device for the regular cleaning of the inner surfaces of vertically arranged heat exchanger tubes comprising resilient members such as springs arranged permanently in the tubes and nozzles for the injection of compressed gas arranged in some distance in front of the openings of the tubes. The pulsed injection of compressed gas from these nozzles is used to cause the resilient members to vibrate inside of the tubes thereby coming into contact with the inner surface of the tubes mechanically scraping off deposits leading to a cleaning of these surfaces.

The afore-mentioned types of auxiliary apparatuses enable at least in part a satisfactory reduction of fouling; however, they increase the mechanical complexity and sensitivity of the overall system, require the use of specific materials that withstand the demanding operational conditions, particularly when subjected to high temperature process media, and necessitate added controls and maintenance. Moreover, such devices are costly and cannot easily be retrofitted to existing heat exchangers.

Consequently, there is a persistent need for novel means to effectively mitigate or even prevent fouling in heat exchangers, which are not subject to the above-mentioned limitations and deficiencies of the technical solutions of the prior art.

SUMMARY OF THE INVENTION

Accordingly, the present invention aims to provide an inexpensive device with a simple construction that enables to effectively reduce or even avoid fouling in heat exchangers in a reliable manner over an extended period of time without exerting substantial stresses on the heat exchanger. The device shall require no maintenance or added controls and be easily installable including the option to retrofit existing heat exchangers. Moreover, it shall be compatible with high temperature applications such as with a hot process gas obtained as effluent from a reactor for the production of carbon black without the risk of a contamination or an adverse influence on the properties of a product recoverable from the process gas such as in particular carbon black.

The inventors to the present invention found by diligent investigations that this object can be achieved by means of an antifouling device as defined herein.

The present invention thus relates to a device for reducing fouling in a heat exchanger tube, the device comprising an elongated displacement body configured to be inserted in the heat exchanger tube to reduce the flow cross-sectional area in a portion of the tube. The device further comprises a mount connected to the elongated displacement body for attaching the device to an end of the heat exchanger tube. The mount is configured to hold the displacement body, when inserted into the tube, in a spaced relationship to the inner surface of the tube.

It has surprisingly been found that such device enables to effectively reduce or even avoid fouling in heat exchangers in a reliable manner over an extended period of time without requiring maintenance, external controls, added chemical agents or exerting substantial stresses on the heat exchanger. Herein, the device is fully compatible with high temperature applications and can be exposed to hot combustion or process gases such as those encountered in the production of carbon black, fumed silica or other particulate matter without contaminating the product recoverable from the process gas or having an adverse influence on the properties thereof.

The device according to the present invention can be provided at relatively low cost, is easily installable and can be retrofitted also to existing heat exchangers thereby representing an attractive versatile means for addressing fouling related issues in heat exchangers.

Without intending to be bound by any theory, the inventors believe that the device according to the present invention enables locally controlling thermal and gas flow characteristics in a heat exchanger tube such that fouling may efficiently be counteracted in a portion of the tube, where fouling would otherwise be expected to occur preferably, such as in the vicinity of an end of the heat exchanger tube or in a region where the thermal gradient between the inner surface of the tube and the process gas flowing through the tube is relatively large. Thus, the displacement body may affect the gas flow characteristics in the heat exchanger tube to which it is installed, particularly increasing the gas flow velocity where the displacement body reduces the flow cross-sectional area of the tube. An increased gas flow velocity is considered to impede a deposition of condensed phase matter on the inner surface of the heat exchanger tube and to promote an erosion of present deposited material. Moreover, the displacement body is in operation heated by the process gas flowing through the heat exchanger tube and may act as emitter and/or reflector of heat radiation causing an increase of the temperature of facing portions of the inner surface of the tube, thereby decreasing the temperature gradient between such portions of the inner surface of the tube and the process gas flowing through the tube. A reduced temperature gradient between the inner surface of the tube and the process gas is considered to reduce the driving forces for a deposition of condensed phase material from the process gas on the inner tube walls, for example by impeding nucleation, condensation and/or thermophoresis processes. Moreover, the inserted displacement body may thus also increase the heat transfer rate, i.e. the rate with which heat is transferred from the process medium across the heat exchanger tube to a heat exchanging fluid, i.e. increase the efficiency of the heat exchange.

The present invention is accordingly also directed towards heat exchangers comprising the antifouling device according to the present invention as well as to the use of the antifouling device according to the present invention for retrofitting a tubular heat exchanger. Thus, it relates to a heat exchanger comprising at least one tube having a first end as inlet for a process medium and a second end as outlet for the process medium. The heat exchanger further comprises a shell through which the at least one tube extends. The shell forms a plenum for a flow of a heat exchanging fluid from an inlet provided in the shell to an outlet provided in the shell enabling an exchange of heat between the process medium and the heat exchanging fluid across the at least one tube. An anti-fouling device according to the present invention is attached via the mount to one or more of the ends of at least one of the one or more tubes with the displacement body inserted in said tube in a spaced relationship to the inner surface of the tube to reduce the flow cross-sectional area in a portion of the tube.

The present invention also concerns a method for reducing fouling on an inner surface of a heat exchanger tube through which a hot process gas entraining condensed phase matter is passed for exchanging heat with a heat exchanging fluid on the outside of the tube. The method comprises providing the heat exchanger tube with an anti-fouling device according to the present invention attached via the mount to an end of the tube, such as the outlet end of the tube, with the displacement body inserted in said tube in a spaced relationship to the inner surface of the tube to reduce the flow cross-sectional area in a portion of the tube.

Heat exchangers with an antifouling device according to the present invention are useful in any kind of applications, where heat exchangers are commonly used. Nevertheless, they are particularly useful in applications, where conventionally severe problems related to fouling may be encountered, for example when the heat exchanger tube is subjected to a particulate-laden process gas obtained as effluent from a reactor for the production of particulate matter such as carbon black, fumed silica or other particulate materials. The heat exchangers according to the present invention have in particular been proven to be beneficial in the production of carbon black. The present invention thus relates also to the use of a heat exchanger comprising an antifouling device as described herein in the production of carbon black. It is furthermore directed towards a process for manufacturing carbon black. This process comprises reacting a fuel with an oxidant to form a hot combustion gas, injecting a hydrocarbon feedstock in the hot combustion gas to form carbon black by pyrolysis of the feedstock in a reactor, quenching of the resulting carbon black containing process medium in the reactor, passing the quenched carbon black containing process medium through the one or more tubes of a heat exchanger according to the present invention thereby transferring heat from the process medium to a heat exchange medium, and separating and collecting the carbon black from the cooled process medium having passed the heat exchanger. A carbon black production plant comprising a combustion reactor and a heat exchanger according to the present invention, e.g. for carrying out this process, is also within the scope of the present invention.

These and further features and advantages of the present invention will be described in more detail below. Reference is made herein to exemplary embodiments and to the appended drawings, which have been included for illustrative purposes to enhance an understanding of the present invention, not to be construed as limiting the scope of the present invention, which is to be given the full breadth of the appended claims and equivalents thereof.

DESCRIPTION OF THE INVENTION

Figure 2:
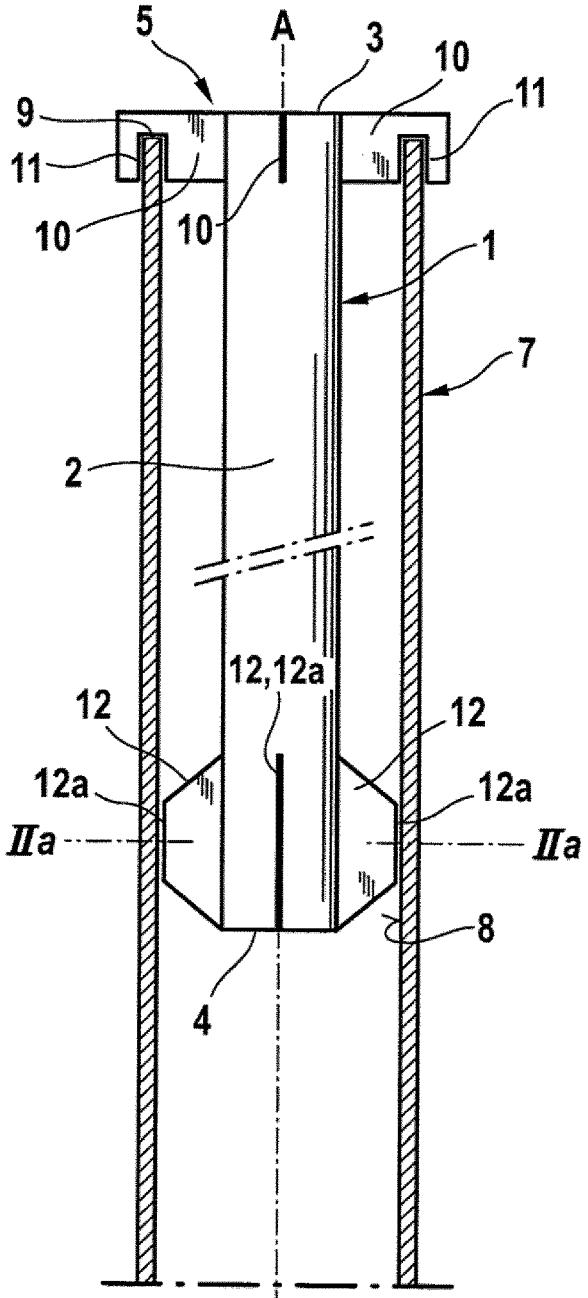
FIG. 2 is a cross-sectional view of the anti-fouling device shown in FIG. 1 attached via its mount to a heat exchanger tube.

As set forth above, the present invention relates to a device for reducing fouling in a heat exchanger tube, also referred to herein as "anti-fouling device". The anti-fouling device according to the present invention comprises an elongated displacement body configured to be inserted in the heat exchanger tube to reduce the flow cross-sectional area in a portion of the tube. The term "flow cross-sectional area" as used herein refers to the area of a cross-section of the tube, which is available for the flow of a fluid such as a gas through the tube. For the sake of clarity, the cross-section of the tube refers to the cross-section in the plane perpendicular to the main axis of the tube. The main axis of the tube means the central axis along the direction of its hollow channel formed by the enclosing tube walls as illustrated in FIG. 2 and designated therein as axis "A". The term "displacement body" as used herein refers to a physical body, which when introduced into the flowpath of a fluid such as a gas maintains its position and causes the flow of the fluid to conform to its shape. In other words, the volume in the flowpath which is occupied by the displacement body is blocked for the flow of the fluid and the fluid is forced to flow along the contours of the displacement body.

The displacement body used in the anti-fouling device according to the present invention is elongated. The term "elongated" as used herein refers to an oblong shape. Accordingly, the displacement body exhibits a preferential direction, wherein its dimensions are greater than in other directions in space. The axis along the preferential direction is also referred to herein as the longitudinal axis of the displacement body (illustrated as axis "A" in FIGS. 1 and 2) and the extension of the displacement body along the longitudinal axis is also referred to as its length. The displacement body generally has two opposite ends along the longitudinal axis, which are referred to herein also as first and second ends of the displacement body. The end of the elongated displacement body which is closer to the mount, which is connected to the displacement body for attaching the device to an end of a heat exchanger tube is referred to herein as the first end of the displacement body. The mount will be discussed in more detail below. The second end opposite to the first end typically represents the leading edge of the displacement body to be inserted furthest into the heat exchanger tube. For achieving a homogenous heat transfer a symmetrical shape of the displacement body may be favourable. In particular the displacement body may have a shape, which is rotationally symmetric with respect to its longitudinal axis. The cross-section of the displacement body can be constant along the longitudinal axis, for example the displacement body can have a cylindrical shape. Alternatively, the cross-section of the displacement body can gradually vary along the longitudinal axis, for example in a linear manner such as in case of the displacement body having a conical or tapered shape or in a non-linear manner including irregular and/or complex shapes like a cylindrical or conical base with one or more protrusions or depressions. Furthermore, the cross section of the body may have any form like e.g. circular, elliptical, triangular, square, or higher polygonal (e.g. penta- or hexagonal) or star-like. The precise shape of the displacement body can be chosen according to the particular needs. For example, a conical shape may provide benefits in terms of aerodynamics, while a cylindrical shape may provide advantages for example in terms of ease of manufacturing. Preferably the displacement body has a cylindrical shape or a conical shape. The first and second ends of the displacement body can have any type of shape in accordance with the needs and desired flow characteristics in the particular case. For example, although not being limited thereto, the first end and the second end can each individually be straight, blunt, angled, tapered, pyramidal or rounded. A straight end, i.e. a planar end perpendicular to the longitudinal axis, may be beneficial for example in terms of simplicity and ease of manufacturing. Other end configurations such as tapered, pyramidal or rounded may provide enhanced aerodynamical characteristics. A rounded shape could be particularly beneficial for the second end as it avoids sharp edges and corners, which may act as nucleation sites for the deposition of condensed phase matter.

Figure 1:
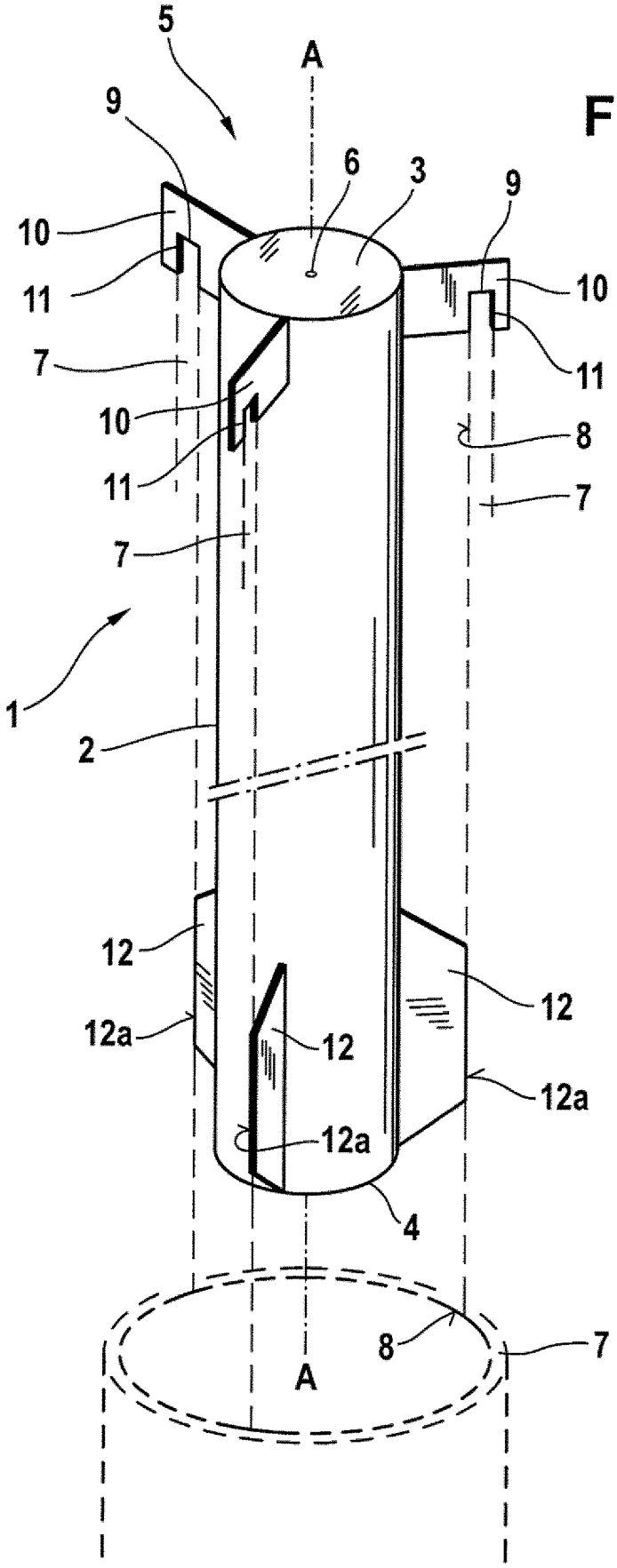
FIG. 1 represents a perspective view of an exemplary embodiment of an anti-fouling device according to the present invention. Mounting of the anti-fouling device to a heat exchanger tube is illustrated in broken lines.

FIG. 1 shows an exemplary embodiment of an anti-fouling device (1) according to the present invention. Mounting of the anti-fouling device to a heat exchanger tube (7) is illustrated in broken lines including an indication of guidance of the device by its spacers (12) along the inner surface of the tube (7) upon insertion of the device into the tube and an indication of the final installed position with the retaining elements (11) of the structural support members (10) engaging the end (9) of the heat exchanger tube (7). In the depicted embodiment the anti-fouling device (1) comprises an elongated displacement body (2) having a cylindrical shape with a constant cross-section along the longitudinal axis (A) of the displacement body (2). The displacement body (2) has a first end (3) and a second end (4), which are both straight ends in the depicted embodiment. A mount (5) is connected to the elongated displacement body close to the first end (3) for enabling an attachment of the device (1) to an end (9) of a heat exchanger tube (7) and holding the inserted displacement body (2) in a spaced relationship to the inner surface (8) of the tube (7) as illustrated in FIG. 2, which depicts the exemplary device shown in FIG. 1 when installed to a heat exchanger tube.

The displacement body of the anti-fouling device is generally made of a solid material. As such it is typically substantially impermeable to the process medium to which it is exposed in a heat exchanger tube under operational conditions. The material from which the displacement body is made generally should provide suitable properties for the intended application such as corrosion and degradation resistance, as well as appropriate thermal and mechanical characteristics including sufficient strength at the envisaged operational temperature level, which can be as high as 1,000° C. or even more in certain cases such as with effluent process media from a carbon black reactor, and will be chosen in accordance with the particular requirements. For instance, metallic materials, ceramics, inorganic composite materials like cermets or other refractory materials can be used to form the displacement body. Metallic materials, which include metals, alloys and combinations thereof, typically provide advantages in terms of costs and/or workability and are therefore preferably used. Non-limiting examples of metallic materials that can be used to form the displacement body include nickel-based superalloys such as of the Inconel, Hastelloy, Incoloy, Monel type, cobalt- or iron-based superalloys or stainless steels like e.g. 1.4828, 1.4876, and Alloy 800h. For many applications including heat exchangers useful in the production of carbon black stainless steel as readily available, cost-efficient machinable construction material with high strength and chemical stability can advantageously be used according to the present invention.

The displacement body of the antifouling device according to the present invention can be made as a solid body or as a hollow body. For the sake of cost-efficiency and material savings, as well as in order to avoid a high weight burden imposed by the displacement body on the heat exchanger and support structures, the displacement body is preferably a hollow body. The hollow body can have a closed shell, which defines the outer contours and shape of the displacement body and encloses an inner void space. The hollow body can have one or more through holes to enable an equalisation of pressure for the inner void space. If present, such one or more through holes are typically provided at the first end of the displacement body where the mount is arranged such that they do not affect the flow of the process medium in the heat exchanger tube. The one or more optional through holes, if present, typically have a diameter in the range from 1 mm to 10 mm, such as from 2 mm to 5 mm, which usually enables the intended equalisation of pressure. In the exemplary embodiment of the antifouling device (1) shown in FIG. 1 the displacement body (2) is a hollow body with a through hole (6) formed on the first end (3) of the displacement body (2).

The elongated displacement body of the anti-fouling devices according to the present invention is configured to be inserted in a heat exchanger tube. This means that its shape and dimensions are chosen such as to permit inserting the displacement body with its longitudinal axis oriented along the main axis of the tube into the tube of a heat exchanger with which the device is to be used in combination. As such the cross-section of the displacement body will generally be smaller than the flow cross-section of the tube, i.e. the inner diameter of the tube. The displacement body can preferably be dimensioned such that the flow cross-sectional area of the tube is reduced by the displacement body by from 10% to 90%, such as from 20% to 80% or from 25% to 70%, with respect to the flow cross-sectional area of the tube without inserted displacement body. If the displacement body is dimensioned smaller such that the flow cross-sectional area of the tube is reduced by less than 10%, the antifouling effect imparted by the device according to the present invention may be weak or even not noticeable. If the displacement body is dimensioned larger such that the flow cross-sectional area of the tube is reduced by more than 90%, a significant pressure drop may be caused in the tube and the throughput of process medium and the efficiency of the heat transfer can be adversely affected. The length of the displacement body is generally chosen to correspond to the portion of the tube where the flow cross-section shall be reduced to counteract fouling. The displacement body may in principle extend throughout the entire heat exchanger tube, i.e. the displacement body may have a length corresponding to up to 100% of the total length of the heat exchanger tube. Typically, the displacement body will however have a length corresponding to less than 100%, such as up to 90%, for example up to 75%, up to 50%, up to 40%, up to 30, up to 20% or up to 10% of the total length of the heat exchanger tube. The length of the displacement body may be 1% or more, 2% or more, 5% or more, 10% or more, or 15% or more of the total length of the heat exchanger tube. The length of the displacement body can be within a range between any of the above recited values such as in a range from 1 to 70%, or from 5 to 50%, or from 10 to 40% of the total length of the heat exchanger tube. In view of dimensions of heat exchanger tubes currently used in the art the displacement body of the antifouling device according to the present invention can thus for example typically have a length in the range from about 30 cm, or 50 cm, or 1 m, or 2 m to about 10 m, or 7 m, or 5 m and/or have a cross-section of up to 20 cm, or up to 15 cm, or up to 10 cm, or up to 7 cm, or up to 5 cm, such as in a range from 1 cm to 20 cm, or from 2 cm to 15 cm or from 3 cm to 10 cm.

As mentioned previously and illustrated in FIGS. 1 and 2, the antifouling device (1) according to the present invention further comprises a mount (5) connected to the elongated displacement body (2) for attaching the device (1) to an end (9) of the heat exchanger tube (7). The mount (5) is configured to hold the displacement body (2), when inserted into the tube (7), in a spaced relationship to the inner surface (8) of the tube (7) as illustrated in FIG. 2. The term "in spaced relationship" as used herein means that in the mounted state the inserted displacement body is positioned in a distance to the inner surface of the tube. In other words, the displacement body and the inner surface of the tube are not in direct contact with each other, thereby ensuring a flow of the process medium through the tube as well as avoiding an undesirable contact heat transfer between the tube and the displacement body and associated thermal and/or mechanical stresses. The mount is preferably configured to arrange the longitudinal axis of the displacement body substantially parallel to the main axis of the tube. The term "substantially parallel" as used herein means that small deviations from the ideal parallel arrangement can be present, such as a deviation of up to 10°, up to 5° or up to 3° or up to 1°. The mount can in particular be configured to centre the inserted displacement body along the main axis of the tube such that the longitudinal axis of the displacement body and the main axis of the tube can be aligned to each other as illustrated in FIG. 2 (wherein the main axis of the tube and the longitudinal axis of the displacement body correspond to each other and are both illustrated by the depicted axis "A"). The displacement body may create a circumferential gap, such as an annular gap, between the outer surface of the displacement body and the inner surface of the tube in the mounted state (see also FIG. 2*a*). A symmetric relative arrangement with equal radial distances between the outer surface of the displacement body and the inner surface of the tube in a cross-sectional plane perpendicular to the main axis of the tube can be desirable in terms of a uniform flow distribution of the process medium in the region of the tube where the flow cross-sectional area is reduced by the displacement body and promote an efficient homogenous associated heat transmission in case of a cylindrical body. For non-cylindrical bodies the gap should be formed to ensure a homogeneous flow around the body. This can be achieved e.g. if the axis of the body is superposable with the axis of the heat exchanger tube.

The mount (5) typically comprises one or more structural support members (10) for holding the weight of the displacement body (2) and keeping it in a spaced relationship to the inner surface (8) of the tube (7) such as in any configuration as set forth above.

As the mount must not seal the end of the heat exchanger tube to which it is mounted open support structures permitting fluid passage are used. For example, the one or more structural support members (10) can comprise a grid, bar, ring, rod, beam, fin or an assembly or combination thereof. The one or more structural support members (10) or an assembly formed thereof typically are dimensioned such that they extend over the heat exchanger tube (7) when the device (1) is installed so that the load of the device (1) may be supported by the heat exchanger tube (7). The mount (5) is connected to the displacement body (2). This connection can be achieved as illustrated in FIGS. 1 and 2 by one or more of the support members (10) being directly connected to the displacement body (2), typically at or close to the first end (3) of the elongated displacement body. The connection can be made in various manner available to the skilled artisan such as, without being limiting, welding, soldering, adhesive bonding, plug connection, fasteners (such as bolts, screws, rivets etc.) or machining out of a single piece. As an alternative to a direct connection of the displacement body to the one or more support members, the mount can optionally comprise one or more extension members for coupling the displacement body to the one or support members. The optional extension member (not shown in the Figures) can be any kind of holding element arranged between the structural support member(s) and the first end of the displacement body, such as for example a rod, a bar, a chain or a combination thereof. The choice of an extension member of appropriate dimension enables to position the displacement body at any desired distance from the end of the tube, where the device is installed via the mount, and thus to counteract fouling also selectively in portions of the tube remote from its ends, if desired.

The mount enables attaching the anti-fouling device according to the present invention to an end of a heat exchanger tube. For example, as illustrated in FIG. 2, the one or more support members (10) can be configured such that they are held in place on the heat exchanger tube (7), e.g. by providing them with one or more retaining elements (11), which mate with the end (9) of the heat exchanger tube (7), such as recesses, grooves or alike. Alternatively, the mount may further comprise in addition to the one or more support members and the optional extension member(s), if present, one or more attachment means (not shown in the Figures) for an attachment of the device to the end of the heat exchanger tube. Suitable attachment means include any known type of attachment means, such as, without being limited thereto, clamps, resilient members, fasteners such as screws, bolts, rivets, welding, soldering, adhesive bonding, or a plug connection.

In a preferred embodiment, the mount comprises a plurality of, such as at least three, for example three, four, five or six, support members such as fins radially extending from the surface of the displacement body. Preferably the support members are all of the same dimensions and symmetrically arranged with respect to the longitudinal axis of the displacement body. The support members optionally each have a recess at the side which is to face the heat exchanger tube, wherein the recesses are configured to mate with the wall of the heat exchanger tube. For example, in the embodiment shown in FIGS. 1 and 2 the mount (5) comprises three support members in the form of fins (10) radially extending from the surface of the displacement body (2) close to the first end (3) of the displacement body (2). The fins (10) are symmetrically arranged with respect to the longitudinal axis (A) of the displacement body (2) such that the angle between two adjacent fins in the cross-sectional plane is 120° each. The fins each have a recess (11) at their bottom side, i.e. the side which is to face the heat exchanger tube (7). The recesses (11) are configured to mate with the wall (8) of the heat exchanger tube. In the final installed position, the recesses (11) of the structural support members (10) engage the end (9) of the heat exchanger tube (7) as illustrated in broken lines in FIG. 1. Thus, the displacement body (2) can be mounted via the support members (10) with the recesses (11) at an end (9) of the heat exchanger tube (7) and held in a spaced relationship to the inner surface (8) of the tube (7) in a centred manner by gravity only as illustrated in FIG. 2.

According to the present invention the antifouling device may optionally further comprise one or more spacers (12) on the surface of the displacement body. As illustrated in broken lines in FIG. 1 the one or more spacers can serve as guiding elements assisting upon insertion of the displacement body into a heat exchanger tube, with the device guided via the contact surfaces (12*a*) of the guiding elements (12) along the inner surface (8) of the heat exchanger tube (7), and may help to maintain the displacement body in the intended spaced relationship to the inner surface of the tube and to reduce or avoid vibrational movements of the displacement body when installed in the tube. The one or more spacers, if present, can preferably be arranged at or adjacent to the second end of the displacement body, i.e. the distal end from the mount. A spacer includes any kind of structural element configured to keep the displacement body in a spaced relationship from the heat exchanger tube such as fins, blades, protrusions or alike. Typically, the one or more spacers, if present, each extend from the surface of the displacement body in a direction perpendicular to the longitudinal axis of the displacement body. Preferably the one or more spacer is symmetrically arranged with respect to the longitudinal axis of the displacement body.

Figure 2A:
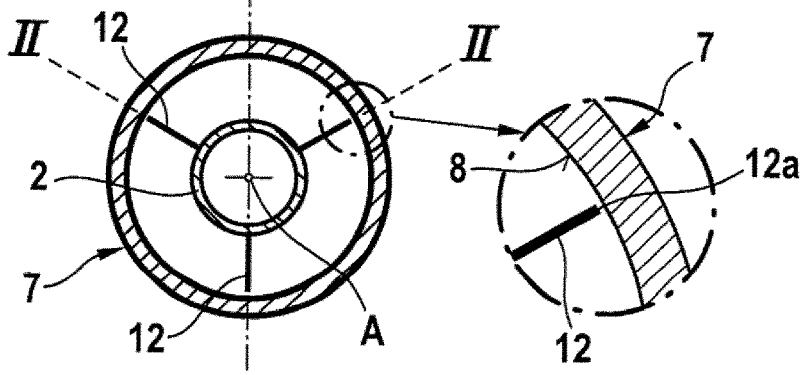
FIG. 2*a* represents a cross-sectional view of the mounted anti-fouling device taken at the plane indicated by lines IIa-IIa in FIG. 2. The enlarged detail view illustrates positioning of the contact surfaces of the spacers of the device in close proximity to/loose contact with the inner surface of the heat exchanger tube.

The device may for example comprise a plurality of spacers, preferably at least three, such as three, four, five or six spacers, such as guiding fins radially extending from the surface of the displacement body. In the exemplary embodiment shown in FIGS. 1 and 2 the device comprises three spacers in the form of fins (12) radially extending from the surface of the displacement body (2) close to the second end (4) of the displacement body (2). As shown in FIG. 2*a* the fins (12) are symmetrically arranged with respect to the longitudinal axis (A) of the displacement body (2) such that the angle between two adjacent fins in the cross-sectional plane is 120° each.

The spacers such as fins can be dimensioned such as to increase the effective circumference of the displacement body by the fins to almost correspond to the cross section of the heat exchanger tube (cf. also enlarged view of FIG. 2*a*). The "effective circumference of the displacement body" means the diameter of the smallest circle in a cross-sectional plane perpendicular to the longitudinal axis that encompasses the displacement body including the spacers protruding from its surface. By "almost corresponds" it is meant that the effective circumference of the displacement body substantially matches to the cross section of the heat exchanger tube, but remains slightly below the latter to enable a straightforward insertion of the displacement body in the tube without the risk of mechanical damage. In practice it may be preferable to dimension the spacers such that the effective circumference of the displacement body is increased by the spacers to be within a range from 95.0 to 99.9% of the cross section of the heat exchanger tube. The precise dimensions of the spacer(s) can be chosen such that taking into account the different thermal expansion coefficients of the heat exchanger tube and the different components of the anti-fouling device the spacers loosely contact the inner wall of the tube under the operational conditions of the heat exchanger. By "loosely contact" a direct surface contact without substantial contact force is meant.

The mount and its component as well as the one or more optional spacers, if present, can be made from the same kind of materials as set forth above for the displacement body. Preferably, the different components of the antifouling device according to the present invention are made from the same material such as for example stainless steel.

The device according to the present invention as described above can be used with any kind of heat exchanger comprising one or more heat exchanger tubes to reduce or eliminate fouling in the tube(s). It can be structured and dimensioned to match different heat exchanger and tube designs and/or dimensions and can thus be used with virtually every type of available tubular heat exchanger. Non-limiting examples of tubular heat exchangers are for instance discussed in U.S. Pat. No. 6,585,949, EP 0 777 098 A2, EP 2 820 366 B1 and VDI-Wärmeatlas, 11th ed., Springer Verlag. A particular advantage of the anti-fouling device according to the present invention is that it can be used for retrofitting existing tubular heat exchangers and thus provides effective remedial means against fouling for heat exchangers in use, which are significantly less expensive and complex than an investment in a new heat exchanger with a design optimized to reduce fouling or retrofitting with a conventional anti-fouling device such as of the injection nozzle type. The installation of the anti-fouling device of the present invention on the heat exchanger is simple and can be accomplished by man within a minimum amount of time.

Figure 3:
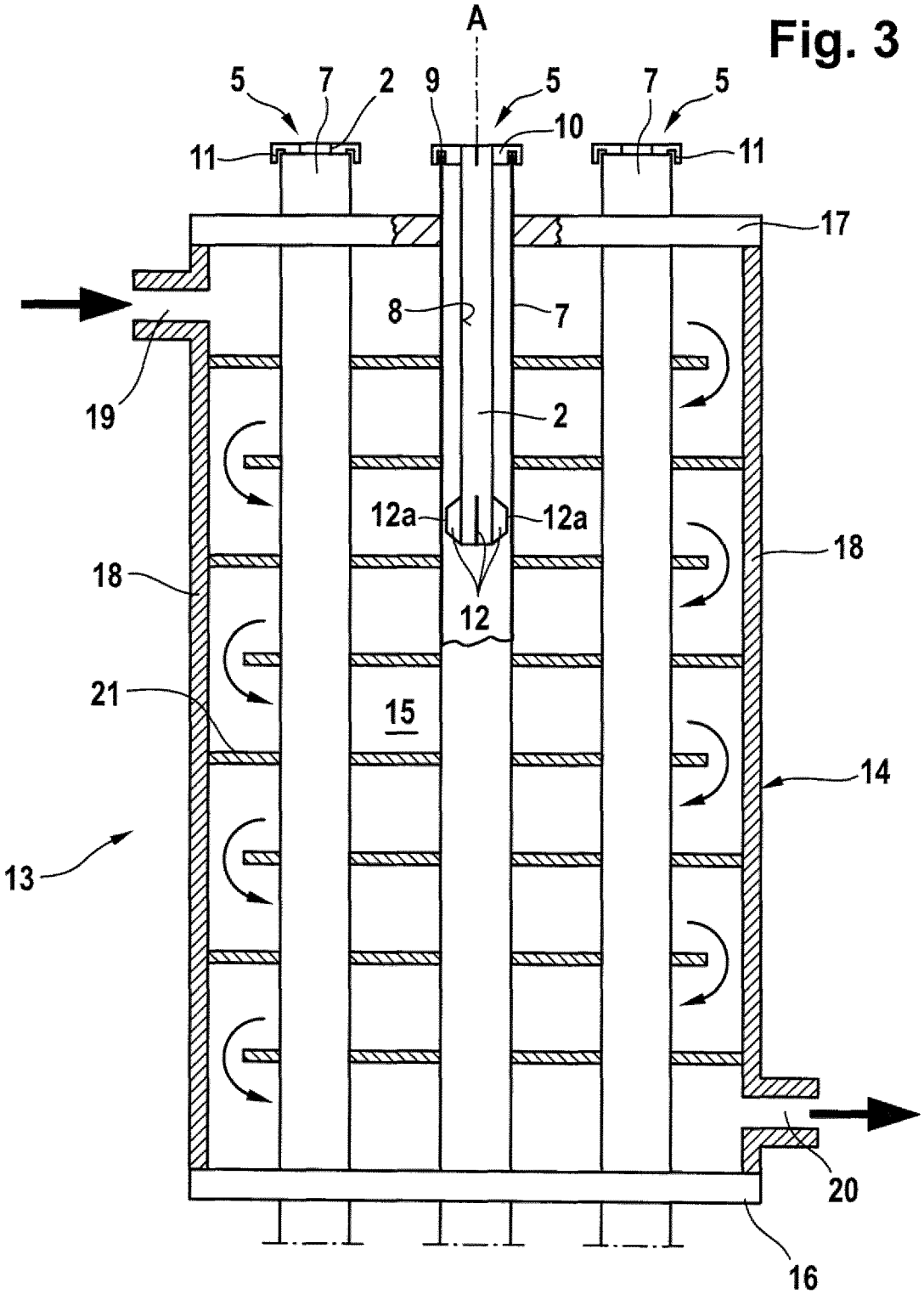
FIG. 3 schematically depicts a heat exchanger according to the present invention comprising anti-fouling devices of the present invention as disclosed herein.

A heat exchanger comprising an anti-fouling device according to the present invention is schematically illustrated in FIG. 3. The heat exchanger (13) comprises at least one tube (7) having a first end serving as an inlet for a process medium and a second end that serves as an outlet for the process medium. Typically, the heat exchanger comprises a plurality of tubes each having a first end serving as an inlet for a process medium and a second end that serves as an outlet for the process medium. In FIG. 3 for example three tubes (7) are shown, however, this is not intended to be limiting, and the heat exchanger can in principle have any desired number of tube(s). Thus, the heat exchanger may include for certain applications up to 300 tubes or even more, for example from 1 to 300 tubes, from 2 to 200 tubes, from 10 to 150 tubes or from 20 to 100 tubes. The tubes are typically of a straight elongated cylindrical shape with a hollow channel extending over their entire length although other shapes such as with a non-circular, e.g. an oval or polygonal such as a square, cross-section could in principle likewise be employed. The dimensions of the tube(s) are not particularly limited such that tubes according to any dimensions as commonly used in the art can be employed. Typically, the tubes each have a length in the range from 1 m to 20 m such as from 3 m to 15 m or from 5 m to 12 m. The tubes typically have an inner diameter (flow cross-section) in the range of 2 cm to 30 cm, such as from 3 cm to 25 cm, from 4 cm to 20 cm or from 5 cm to 15 cm, or from 5 cm to 10 cm. The thickness of the walls of the tubes may for example be in a range from 1 mm to 10 mm, such as from 2 mm to 5 mm. The actual number and dimensions of the tube(s) will be chosen in accordance with the desired heat exchange capacity and flow rate through the heat exchanger. The material of the tube(s) can be any material known from the prior art to be compatible with the operational conditions expected for the intended application. Typical materials are for example stainless steel 1.4828, 1.4876, and Alloy 800h.

As illustrated in FIG. 3 the one or more tubes (7) of the heat exchanger (13) extend through a shell (14). The shell (14) of the heat exchanger (13) is an enclosure that forms a plenum (15) for a flow of a heat exchanging fluid within the boundaries defined by the inner surface of the shell (14). The shell may comprise a bottom plate (16) and a top plate (17) positioned parallel and in a distance to each other for holding the one or more tubes in a fixed spatial arrangement with the one or more tubes extending through the pair of plates. The entrance plate of the carbon black-laden gas might be cooled with a part of the heat exchanging fluid. This stream can be mixed afterwards into the main heat exchanging fluid stream at any point before, in or after the heat exchanger. The shell (14) further comprises sidewalls (18), which connect the bottom plate (16) and the top plate (17) enclosing the one or more tubes (7) arranged between them. An inlet (19) for heat exchanging fluid and an outlet (20) for heat exchanging fluid are provided in the shell (14), typically as openings in the sidewalls (18). The inlet (19) and the outlet (19) are preferably provided at distant positions on the shell, one of them usually being provided close to the bottom plate, such as the outlet (20) in FIG. 3, and the other one close to the top plate (17), such as the inlet (19) in FIG. 3. The described arrangement enables a flow of a heat exchanging fluid from the inlet (19) provided in the shell via the plenum (15) containing the one or more tubes (7) to the outlet (20) provided in the shell. Thus, heat may be exchanged across the walls of the tube(s) between a process medium flowing through the one or more tubes and the heat exchanging fluid flowing on the outside of the tubes through the plenum (15). The heat exchanger according to the present invention may optionally further comprise means for optimizing the flow and distribution of the heat exchanging fluid through the plenum (15). For example, as indicated schematically in FIG. 3, guide or baffle plates (21) can be provided inside the shell (14) to control the flowpath of the heat exchanging fluid through the plenum (15). Furthermore, fluid distribution structures such as double shell designs as known from the art can be implemented.

As a characteristic feature, the heat exchanger (13) comprises an anti-fouling device according to the present invention attached via its mount (5) to one of the ends of at least one of the one or more tubes (7) with the displacement body (2) inserted in said tube in a spaced relationship to the inner surface of the tube (7) to reduce the flow cross-sectional area in a portion of the tube (7). FIG. 3 shows a heat exchanger with an antifouling device according to the present invention installed to an end of each of its tubes with the antifouling device mounted to the centre tube being shown in a sectional view for the sake of illustration. It is however to be understood that this is for illustrative purposes only and by no means intended to be limiting. The present invention rather foresees that an anti-fouling device according to the present invention can be mounted to any desired number of the tubes present in the heat exchanger such as a single tube, a plurality of tubes corresponding to a selection from the total number of tubes of the heat exchanger, or all tubes of the heat exchanger. As fouling typically pertains all tubes of a heat exchanger preferably each and every tube of the heat exchanger is provided with an anti-fouling device according to the present invention. The anti-fouling device according to the present invention may be mounted to one or more of the ends of the heat exchanger tube such as the first end serving as inlet for a process medium or the second end serving as outlet for a process medium or to both ends, if desired. Frequently, fouling occurs predominantly in a certain portion of the tube such as in the vicinity of one of its ends such that the antifouling device can be used to selectively counteract fouling in this portion of the tube. Accordingly, in many cases it is useful to provide the heat exchanger with an anti-fouling device according to the present invention mounted to a certain end of the one or more tubes such as the first end serving as inlet for a process medium or the second end serving as outlet for a process medium. In a preferred embodiment, the heat exchanger thus comprises a plurality of tubes each having a first end as inlet for a process medium and an opposite second end as outlet for the process medium and an anti-fouling device of the present invention attached to one of these ends. Preferably an anti-fouling device of the present invention is provided to the same kind of end (inlet or outlet) among the tubes provided with an anti-fouling device such as each and every tube of the heat exchanger. For example, as it has been observed that in certain applications fouling tends to occur predominantly at the outlet side of the tubes, it may be preferred to attach the anti-fouling device(s) according to the present invention to the second end serving as outlet for the process medium.

The one or more anti-fouling devices comprised by the heat exchanger can each individually be of any configuration including shape, dimensions and arrangement with respect to the heat exchanger tube as described in detail above in the context of the anti-fouling device. Thus, the anti-fouling device may for example be mounted on the tube such that the longitudinal axis of the displacement body is substantially parallel to, or is even aligned with, the main axis of the tube as depicted in FIG. 2. The displacement body of the device can in particular have a rotationally symmetric shape with respect to its longitudinal axis such as a cylindrical or conical shape. The length and cross-sectional dimensions of the displacement body can be as described previously. The displacement body may in particular be dimensioned such that the flow cross-sectional area of the tube is reduced by the displacement body by from 10% to 90%, such as from 20% to 80% or from 25% to 70%, with respect to the flow cross-sectional area of the tube without inserted displacement body. Moreover, the displacement body of the anti-fouling device may usually extend over a length of up to 70%, such as up to 50%, of the total length of the heat exchanger tube. For example, it may have a length in the range from 10% to 50% of the total length of the heat exchanger tube. It has been found that a reduction of fouling is particularly effective in certain applications, if the displacement body is configured such that the flow velocity of the process medium in the portion of the tube with the reduced flow cross-sectional area is at least 50 m/s, such as 60 m/s or more, or 80 m/s or more, or 100 m/s or more. In some cases the displacement body is configured such that the flow velocity of the process medium in the portion of the tube with the reduced flow cross-sectional area is within +/−30%, preferably +/−20%, of the initial flow velocity of the process medium at the inlet of the tube The heat exchanger according to the present invention can be spatially arranged in any suitable manner. Preferably, the one or more than one tubes of the heat exchanger are arranged substantially vertically as also illustrated in FIG. 3. With such a vertical arrangement an anti-fouling device of the present invention can be supported by the upper end of the respective tube to which it is attached via the mount and held in place by gravity without the need of additional means as shown e.g. in FIGS. 2 and 3. Nevertheless, other spatial arrangements of the heat exchanger are also possible and the heat exchanger according to the present invention can for example be of a horizontal type with tubes of the heat exchanger arranged substantially horizontally with respect to the supporting ground. The term "substantially vertical" or "substantially horizontal" as used herein mean that small deviations from the ideal respective arrangement, i.e. 90° orientation with respect to the ground in case of a vertical orientation or 180° with respect to the ground in case of a horizontal orientation, can be present, such as a deviation of up to 5° or up to 3° or up to 1°.

The mode of operation of the heat exchanger is not particularly limited. Thus, the heat exchanger for example can be operated with the process medium and the heat exchanging fluid flowing in counter-current mode, in parallel current mode or in a crossed flow mode. Preferably, the heat exchanger according to the present invention is though operated in counter-current mode. Moreover, the kind of process medium and type of heat exchanging fluid is not particularly limited according to the present invention and the anti-fouling device or a heat exchanger comprising the same described herein be used with any kind of process medium and type of heat exchanging fluid that would conventionally be used in the respective particular application of interest.

The anti-fouling device according to the present invention has been found to enable an efficient reduction or even elimination of fouling in heat exchanger tubes and may moreover improve the heat transfer rate.

As previously mentioned, the present invention thus also relates to a method for reducing fouling on an inner surface of a heat exchanger tube through which a hot process gas entraining condensed phase matter is passed for exchanging heat with a heat exchanging fluid on the outside of the tube. The expression "hot process gas", "hot process medium" or alike refers to a gas or fluid medium generated in the course of a process such as an industrial production process or a combustion process which has a temperature greater than ambient temperature, usually substantially greater than ambient temperature such as having a temperature of at least 100° C., or at least 400° C. The term "condensed phase matter" refers to matter in solid or liquid form. The condensed phase matter may particularly be present in particulate form. The term "particulate" includes particles, droplets, agglomerates and other discrete physical entities of condensed phase matter. The condensed phase matter e.g. in particulate form is typically dispersed in the hot process gas and may deposit on the inner surface of the heat exchanger tube. In order to avoid this fouling the method according to the present invention foresees providing the heat exchanger tube with an anti-fouling device according to the present invention attached via the mount to an end of the tube, such as the outlet end of the tube, with the displacement body inserted in said tube in a spaced relationship to the inner surface of the tube to reduce the flow cross-sectional area in a portion of the tube.

The anti-fouling device used according to this the method of the present invention can be of any configuration including shape, dimensions and arrangement with respect to the heat exchanger tube as described in detail above in the context of the anti-fouling device and heat exchanger according to the present invention. Particularly, the anti-fouling device may for example be mounted on the tube such that the longitudinal axis of the displacement body is substantially parallel to, or is even aligned with, the main axis of the tube. Moreover, the displacement body of the device can in particular have a rotationally symmetric shape with respect to its longitudinal axis such as a cylindrical or conical shape. The length and cross-sectional dimensions of the displacement body can be as described previously. In certain applications, the method involves increasing the flow velocity of the process medium in the portion of the tube with the reduced flow cross-sectional area by the displacement body to at least 50 m/s, such as 60 m/s or more, or 80 m/s or more, or 100 m/s or more. In some cases the displacement body is configured such that the flow velocity of the process medium in the portion of the tube with the reduced flow cross-sectional area is adjusted by the inserted displacement body of the anti-fouling device to be within +/−30%, preferably +/−20%, of the initial flow velocity of the process medium at the inlet of the tube. The anti-fouling device according to the present is compatible with high temperature applications. The hot process gas entraining condensed phase matter according to the method of the present invention can for example have an initial temperature of 400° C. or more such as in the range from 400° C. to 1,200° C. The method for reducing fouling according to the present invention is for instance well suited and effective for heat exchanger tubes which are subjected to a hot particulate-laden process gas from a combustion process or a process for the production of particulate materials such as carbon black, fumed silica or other particulate materials such as metal oxides. The hot process gas entraining condensed phase matter may thus for example be an effluent from a reactor for the production of carbon black.

As previously mentioned, the heat exchangers with an antifouling device according to the present invention are particularly useful in applications, where conventionally severe problems related to fouling may be encountered, for example when the heat exchanger tube is subjected to a particulate-laden process gas obtained as effluent from a reactor for the production of particulate matter such as carbon black, fumed silica or other particulate materials, and have in particular been proven to be useful in the production of carbon black. The present invention is thus also directed towards a process for manufacturing carbon black making use of a heat exchanger of the present invention as well as a carbon black production plant comprising such a heat exchanger, wherein such manufacturing process can be conducted, as described beforehand. These aspects of the present invention will be described with reference to FIG. 4, which shows a schematic block diagram of a carbon black production plant including a heat exchanger according to the present invention.

Figure 4:
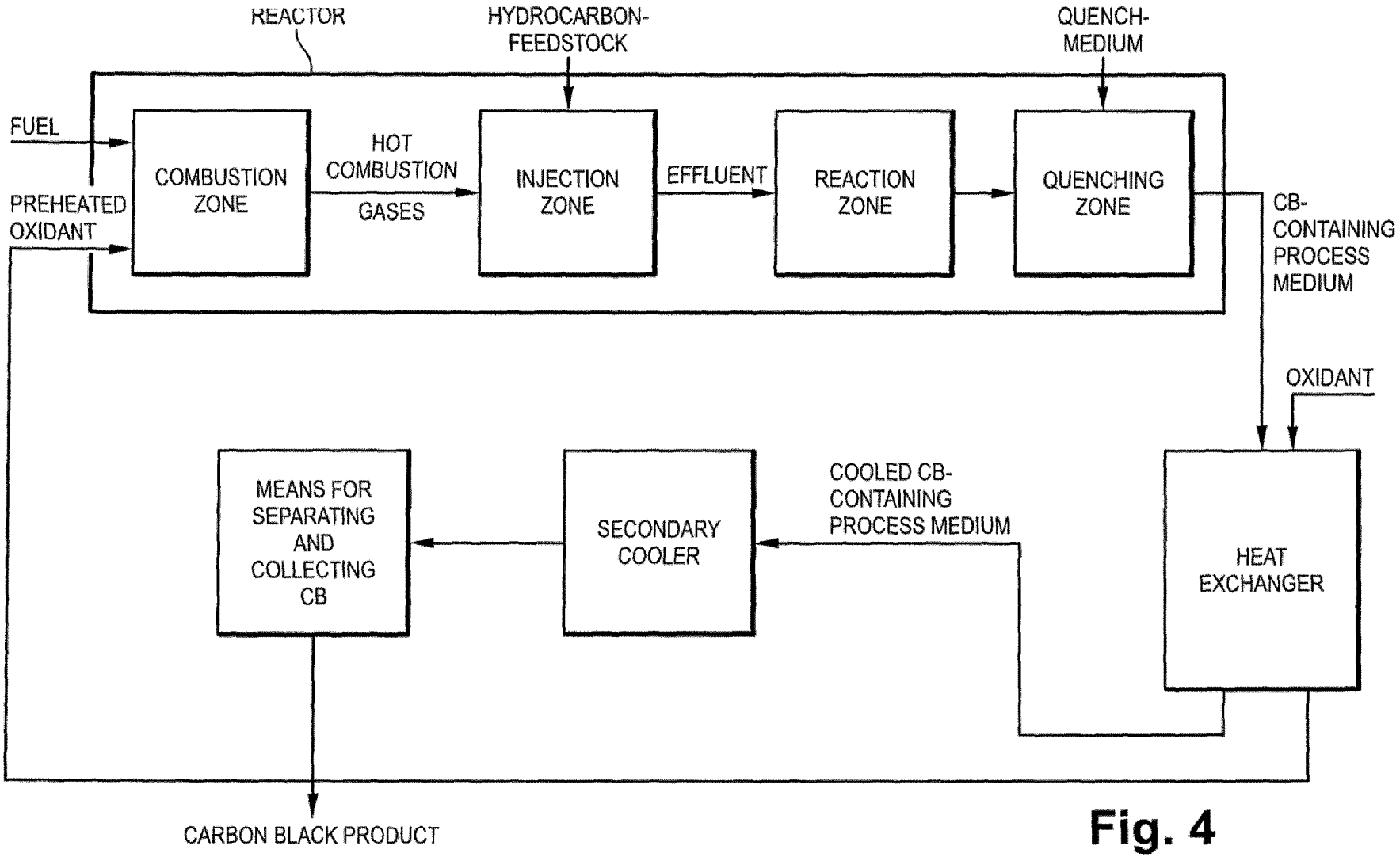
FIG. 4 represents a schematic block diagram of a carbon black production plant including a heat exchanger according to the present invention such as depicted in FIG. 3.

The carbon black is formed by pyrolysis of a hydrocarbonaceous feedstock under controlled conditions in a reactor. The reactor can be of any type conventionally used for the manufacture of carbon black, particularly a reactor for the production of furnace blacks. As shown in FIG. 4, the reactor may comprise different zones such as a combustion zone, an injection zone, a reaction zone and a quenching or temperature reduction zone. A fuel and an oxidant are fed to the reactor, for example to a burner in the combustion zone, to generate a hot combustion gas by reaction of these components. The fuel is generally a hydrocarbonaceous fuel such as a hydrocarbon oil or a gas and the oxidant is typically air, oxygen or oxygen-enriched air, preferably air.

The oxidant introduced to the reactor is typically preheated as will be discussed in more detail below. The hot combustion gas generated by combustion of the fuel attains high temperatures such as in the range from 1,200 to 2,000° C. or even more. The reactor is generally lined with a refractory material able to withstand such high temperatures. A hydrocarbonaceous feedstock is then injected into the stream of hot combustion gases. This can be achieved by means of injection nozzles at one or more positions in an injection zone downstream of the combustion zone of the reactor. A variety of liquid and gaseous hydrocarbonaceous materials can be used as feedstock. Suitable feedstocks include for example natural gas, mineral oils, vegetable oils, hydrocarbon oils e.g. derived from coal or crude oil processing such as naphtha or gasoil, distillates from coal tar and oils that are obtained by cracking of petroleum fractions. Due to the high temperatures of the hot combustion gases the injected hydrocarbonaceous feedstock thermally decomposes and a formation of carbon black by pyrolysis of the feedstock proceeds as the mixture of the feedstock and the hot combustion gases passes through a reaction zone downstream of the injection zone of the reactor. The resulting carbon black containing process medium is then quenched in a quenching zone to stop reactions. Quenching can be achieved by injecting a quenching medium such as water or steam into the carbon black containing process medium received from the reaction zone of the reactor or applying a quench boiler system for this purpose. The injected quench medium lowers the temperature of the process medium to a level at which the pyrolysis reaction does not proceed anymore with a significant rate, such as to a temperature of less than 1,200° C., typically less than 1,000° C., for example in a range from 400° C. to 1,200° C. By adjusting the position of the quench medium injection it is possible to control the reaction time and thereby characteristics of the formed carbon black such as the particle size distribution. Typically, the reaction time is in a range from a few milliseconds to 2 seconds. Generally, it is possible to produce carbon black grades with very different characteristics by adjusting the reactor design and manufacturing conditions (cf. for example Jean-Baptiste Donnet, Roop Chand Bansal, Meng-Jiao Wang, Carbon Black, 2nd edition, CRC Press, 1993). The skilled artisan will select a suitable reactor design and reaction conditions in accordance with the desired properties of a particular carbon black to be produced.

The quenched carbon black containing process medium obtained as effluent from the reactor is passed through the one or more tubes of a heat exchanger according to the present invention thereby transferring heat from the process medium to a heat exchange medium. The heat exchanger according to the present invention can be of any configuration as set forth above including in particular any shape, dimensions and arrangement of the comprised one or more anti-fouling device(s) according to the present invention with respect to the heat exchanger tube(s). Typically, the heat exchanger used according to the present invention in the production of carbon black comprises a plurality of parallel heat exchanger tubes extending through an enclosing shell defining a plenum for a flow of the heat exchanging fluid from an inlet provided in the shell to an outlet provided in the shell. The heat exchanger is preferably vertically arranged, i.e. the tubes are oriented substantially vertically with respect to the ground. One or more than one or all of the tubes can have an anti-fouling device according to the present invention mounted to an end of the tube. The one or more anti-fouling devices are preferably mounted to the upper end of the tube(s). In such case they may be held in place with respect to the tube(s) by the mount using gravity such as illustrated and discussed above in the context of FIGS. 2 and 3. When the hot carbon black-laden process medium is passed through the tubes, heat is transferred across the tube walls to the stream of heat exchanging fluid flowing on the outer surface of the tubes in the plenum. The heat exchanger is typically operated in counter current mode. The quenched carbon black containing process medium obtained as effluent from the reactor is typically supplied to the tube(s) at the bottom end and passes through the tube(s) of the heat exchanger to exit at their top end with a reduced temperature. The heat exchanging medium such as air typically is introduced to the plenum by an inlet provided in an upper part of the shell and exits the heat exchanger by an outlet provided in a lower part of the shell (as depicted for example in FIG. 3). The temperature of the heat exchanging fluid may be increased via the heat exchange with the process medium occurring in the plenum to a temperature as high as about 1,000° C., such as in the range from 500 to 800° C., at the outlet.

Different heat exchanging fluids can be used according to the present invention. Non-limiting examples include air, oxygen, oxygen-enriched air, nitrogen-enriched air, water or steam. Typically, the heat exchanging medium used in the process for the manufacture of carbon black according to the present invention corresponds to an oxidant as used for the generation of the hot combustion gas in the reactor such as preferably air. As illustrated in FIG. 4, the oxidant such as air after being preheated in the heat exchanger can be fed to the reactor to form the hot combustion gas. Thus, a part of the heat generated by the combustion reaction can be recuperated by means of the heat exchanger and be used for preheating starting materials used for the production of carbon black thereby increasing the overall efficiency of the process.

The use of a heat exchanger according to the present invention including the anti-fouling device disclosed herein enables to efficiently reduce fouling of the inner surface of the heat exchanger tube(s) and to maintain a high heat exchange efficiency over extended periods of operations without the need for maintenance or other complex and/or expensive auxiliary cleaning means.

The carbon black-laden process medium after having been cooled by passage through the heat exchanger is passed to a means for separating and collecting the carbon black from the cooled process medium. The means for separating and collecting the carbon black typically comprises a filter unit, such as a bag filter.

As illustrated in FIG. 4, the carbon black-laden process medium exiting the heat exchanger may optionally be passed through one or more secondary cooling units such as further heat exchangers, which may or may not be heat exchangers according to the present invention, to further cool the process medium before collecting and separating the carbon black from the process medium.

The use of a heat exchanger according to the present invention enables to effectively counteract fouling and enhances process efficiency without the risk of a contamination or an adverse influence on the properties of the carbon black product.

The features and advantages of the present invention will be further illustrated by the following non-limiting example, which demonstrates the use of an anti-fouling device according to the present invention in a heat exchanger used as air pre-heater in a carbon black production process and the benefits achievable thereby.

Example

Carbon black was produced using a furnace reactor. The reactor includes a combustion chamber, an oil injection zone, a reaction zone, and a quench zone. The used setup further comprised a heat exchanger (24 tube, type 900+ single pass heat exchanger from Ekström & Son A B Sweden) coupled with the reactor. The heat exchanger was equipped with a steam cleaning device similar to the type described in U.S. Pat. No. 4,366,003. In the combustion chamber natural gas was combusted with air that was preheated to a temperature of about 620° C. using the heat exchanger to which smoke gas (i.e. a mixture of carbon black and reaction gases obtained as carbon black containing process medium from the reactor) was supplied as set forth in more detail below, to produce a stream of hot combustion gases. In the injection zone downstream of the combustion zone, oil is then injected into the generated stream of hot combustion gases. The used oil type is a coal tar distillate with the following analytical characteristics:

| C [wt. %] | H [wt. %] | N [wt. %] | S [wt. %] | O [wt. %] | $H_2O$ [wt. %] | Ash [wt. %] |
|---|---|---|---|---|---|---|
| 91.5 | 5.7 | 0.9 | 0.7 | 1.2 | 0.03 | 0.002 |

The given elemental mass fractions of carbon, hydrogen, nitrogen, sulfur and oxygen refer to a dry and ash free basis. The amount of oil is adjusted to reach a STSA of about 120 $m^2/g$ for the final carbon black product. The oil is converted together with the hot combustion gas from the combustion chamber to carbon black and tailgas in the subsequent reaction zone. The reaction is then stopped in the quenching zone using a water quench and cooling the stream down to 720° C.

Downstream of the quench zone the smoke gas passes the above-mentioned heat exchanger. The heat exchanger tubes were vertically arranged with respect to the ground. The heat exchanger was operated in counter current mode supplying the hot carbon black containing process medium obtained as effluent from the reactor to the bottom end of the tubes of the heat exchanger and passing it upwards through the tubes to their top end, while passing a stream of air used as heat exchanging fluid from an inlet close to the top end of the shell via the interior of the shell over the outside surface of the tubes enclosed therein to an outlet close to the bottom of the shell. The heat exchanger is designed to operate at 2000 to 3500 $Nm^3/h$ air and has a maximum pressure drop on the air and smoke gas side of 110 mbar.

The temperature of the smoke gas and the temperature of the air were each measured at the respective inlet of the heat exchanger as well as the respective discharge of the heat exchanger by thermocouples. These measured temperature values were then used to determine the thermal transmission coefficient k. For this purpose, the heat flow transferred to the air was calculated according to $$\Phi_q=\Phi_m c_p(T_{air,out}-T_{air,in})$$

using the set mass flow, the specific isobaric heat capacity (1107 J/kgK for the given settings), the measured air temperature at the heat exchanger discharge, and the measured air temperature at the heat exchanger inlet, which are denoted by $\Phi_m$ $c_p$ $T_{air,out}$–$T_{air,in}$, respectively. The average temperature difference between the smoke gas and the air is furthermore determined by $$\Delta\vartheta_m = \frac{(T_{smoke,in} - T_{air,out}) - (T_{smoke,in} - T_{air,out})}{\ln\left(\frac{(T_{smoke,in} - T_{air,out})}{(T_{smoke,in} - T_{air,out})}\right)}$$

wherein the measured smoke gas temperature at the heat exchanger inlet, and the smoke gas temperature at the measured heat exchanger discharge are denoted by $T_{smoke,inl}$ $T_{smoke,out}$ respectively.

The thermal transmission coefficient k times the heat transfer area A can then be determined using the equation $$KA\vartheta_m=\Phi_q.$$

For comparison reasons, kA is related to a reference area Ao being determined according to $$\frac{k_{start}A}{A_0} = 1\frac{kW}{m^2K}$$

with the thermal heat transmission coefficient at the start of the measurement being denoted by $k_{start}$.

The steam cleaner of the heat exchanger was used to create a reproducible starting condition before each trial by removing deposits of a previous run from the inner surface of the tubes by injecting steam pulses to the inner of the tubes. For reference purposes trials were first conducted with the heat exchanger having no additional anti-fouling device installed to the tubes. For each trial the heat exchanger was continuously operated for a duration of typically from 6 to 7 hours as set forth above with the carbon black containing process gas obtained as effluent from the reactor and air to be preheated as heat exchanging fluid. During the operation the thermal heat transmission coefficient was determined as described above as an indicator for fouling. In total 10 reference trials were thus sequentially conducted. Subsequently, the tubes of the heat exchanger were each provided with an anti-fouling device according to the present invention mounted to their upper end. The used anti-fouling device had a structure as illustrated in FIG. 1 with a hollow cylindrical displacement body having a length of 4 m, a mount comprising three fins radially extending from the outer surface of the displacement body close to one end thereof and three guiding fins radially extending from the outer surface of the displacement body close to the opposite end of the displacement body. The lateral extension of each guiding fin was 22 mm and the height 54 mm. The fins of the mount each had a recess mating with the wall of the tube. The tubes are mounted on the heat exchanger tubes by the mounting fins each having 40 mm lateral extension, 30 mm height and a 5 mm slit to engage the heat exchanger tubes having an internal diameter of approx. 82 mm and a length of about 9 m. One of such anti-fouling devices was installed on each tube of the heat exchanger by inserting the displacement body into the tube at the upper end of the tube until it came to rest with the recesses in the fins of the mount mating the tube walls at the upper end of the tube. The thus mounted anti-fouling device was held in place by gravity with the displacement body centered in the tube with its longitudinal axis aligned with the main tube axis creating an annular gap between the outer surface of the displacement body and the inner tube walls. Trials were then conducted with the heat exchanger with the anti-fouling devices according to the present invention installed to the tubes applying the same operation conditions and determining the thermal heat transmission coefficient in the same manner as set forth above for the reference trials. One trial was run for over hours to evaluate the performance on a longer time scale. The process conditions are summarized in the Table 1 below:

TABLE 1

| | | |
|---|---|---|
| Air mass flow | kg/s | 1, 11 |
| Reactor outlet temperature | ° C. | 725° C. |
| Air Temperature @ Inlet | ° C. | 66 |

Figure 5A:
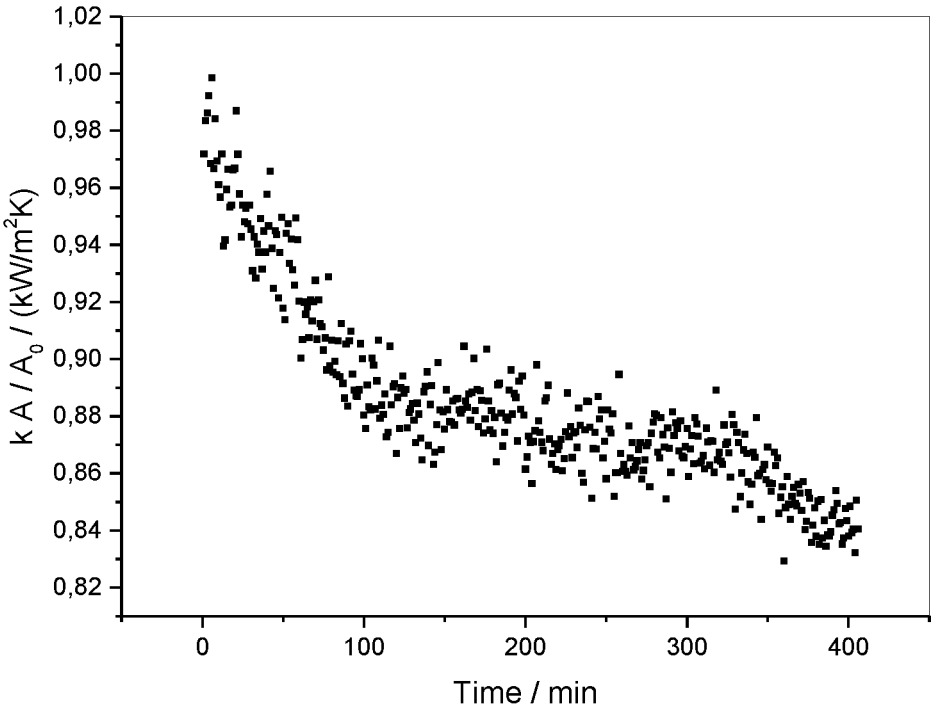
FIG. 5A shows a representative plot of the thermal heat transmission coefficient k times heat transfer area ratio A/Ao versus time as measured for a reference trial according to the Example presented in this disclosure below for a heat exchanger without an anti-fouling device according to the present invention mounted to the heat exchanger. The area ratio is chosen such that k A/Ao is 1 $kW/m^2K$ at the beginning of the trial.
Figure 5B:
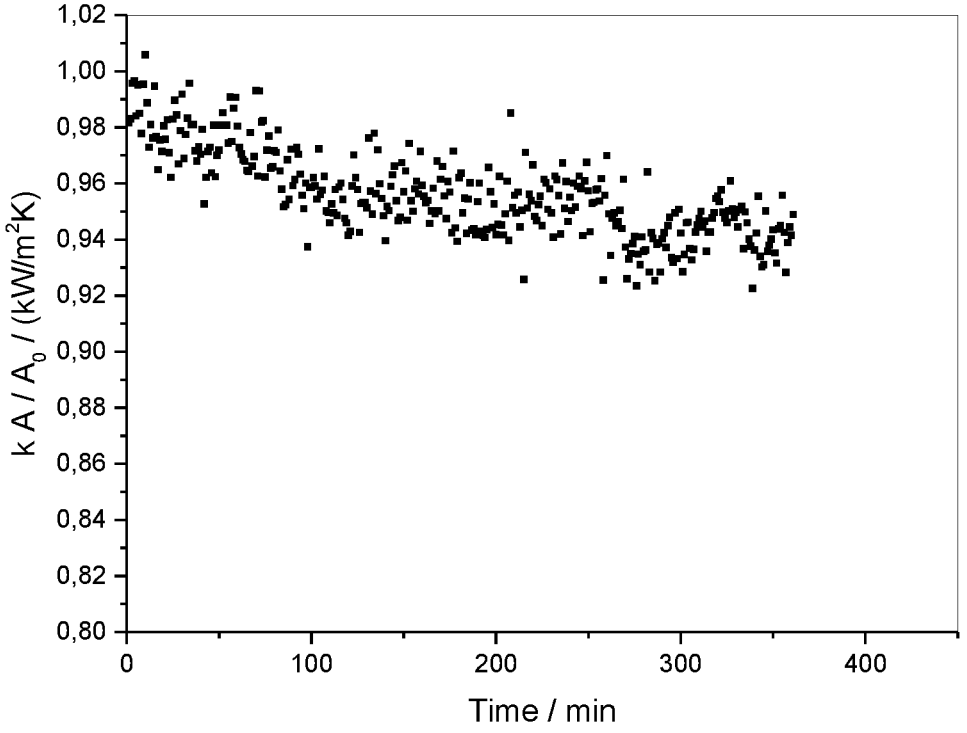
FIG. 5B shows a representative plot of the thermal heat transmission coefficient k times heat transfer area ratioA/Ao versus time as measured for a trial according to the Example presented in this disclosure below for a heat exchanger with an anti-fouling device according to the present invention mounted to the heat exchanger. The area ratio is chosen such that k A/Ao is 1 $kW/m^2K$ at the beginning of the trial.

FIGS. 5A and 5B show a representative plot of the determined thermal heat transfer coefficient, expressed as kA/Ao, as a function of time for the reference trials without anti-fouling device (FIG. 5A) and the trials with the anti-fouling device according to the present invention (FIG. 5B), respectively. As seen from FIG. 5A in case of the reference trials kA/Ao decreased significantly over the first 1-2 hours from the initial value of 1 $kW/m^2K$ to about 0.88 $kW/m^2K$ and subsequently further to a value of about 0.85 $kW/m^2K$ after about 6 hours, i.e. the heat conductivity in total decreased by about 15% over a duration of 6 hours. A further decrease of the thermal heat transmission coefficient was observed for longer runs as is also indicated by the continuous negative slope in the plot in FIG. 5A. In contrast thereto, FIG. 5B indicates that the thermal heat transmission coefficient, expressed as kA/Ao, decreased only slightly from the initial value of 1 $kW/m^2K$ by about 5% to a value of 0.95 $kW/m^2K$ after 6 hours of operation for the trials employing the anti-fouling device according to the present invention. No significant further decrease was observed in the trial with extended duration of more than 20 hours. These finding indicate that a decrease of thermal heat transmission coefficient associated to fouling on the inner surface of the tubes of the heat exchanger can effectively be reduced and stable operational conditions be achieved by the use of the anti-fouling device according to the present invention. No negative impact of the device on the structural integrity of the heat exchanger was observed.

In order to investigate potential effects of the anti-fouling device on the quality of the carbon black product samples of the carbon black material separated and collected from the carbon black containing process medium after it had passed the heat exchanger by means of a filter were analyzed.

Table 2 shows the results of this analysis for the carbon black product obtained in the reference trials versus the carbon black product obtained in the trials with the anti-fouling device according to the present invention installed to the heat exchanger. The reported values are average values with standard deviation over the total number of conducted reference trials or trials, respectively.

TABLE 2

| Property | Carbon black obtained in reference trials | Carbon black obtained in trials with anti-fouling device of the present invention |
|---|---|---|
| $I_2$ absorption [mg/g] | 310 ± 18 | 317 ± 15 |
| STSA [$m^2/g$] | 120 ± 4 | 122 ± 5 |
| OAN [mL/100 g] | 128 ± 3 | 130 ± 3 |
| BET [$m^2/g$] | 281 ± 19 | 290 ± 18 |
| Transmission [%] | 99.9 ± 0.1 | 99.9 ± 0.1 |

The iodine absorption number was measured in accordance with ASTM D-1510.

The statistical thickness surface area (STSA) was measured in accordance with ASTM D-6556.

The oil absorption number (OAN) was determined according to ASTM D2414.

The BET surface area was determined by nitrogen absorption as total surface area using the Brunauer Emmett Teller method in accordance with ASTM D-6556.

The reported transmission values were measured according to ASTM D-1618.

The comparison of the data in Table 2 indicates that the properties measured for the carbon black produced in the trials with the anti-fouling device according to the present invention installed on the heat exchanger and the reference trials without such device are comparable and do not differ within tolerances. This shows that the use of the anti-fouling device of the present invention did not adversely affect the product characteristics.

LIST OF REFERENCE SIGNS

1 Anti-fouling device
2 Displacement body
3 First end of displacement body
4 Second end of displacement body
5 Mount
6 Through hole
7 Heat exchanger tube
8 Inner surface of heat exchanger tube
9 End of heat exchanger tube
10 Structural support member
11 Retaining element
12 Spacer
12*a* Contact surface of spacer
13 Heat exchanger
14 Shell
15 Plenum
16 Bottom plate
17 Top plate
18 Sidewall
19 Inlet for heat exchanging fluid
20 Outlet for heat exchanging fluid
21 Guide/baffle plates
A Main axis of heat exchanger tube/longitudinal axis of displacement body

The invention claimed is:

1. A device for reducing fouling in a heat exchanger tube, comprising:

(a) an elongated displacement body configured to be inserted in a heat exchanger tube to reduce the flow cross-sectional area in a portion of the tube, wherein the displacement body is a hollow body having a closed shell, which defines the outer contours and shape of the displacement body and encloses an inner void space, and (b) a mount connected to the elongated displacement body for attaching the device to an end of the heat exchanger tube, the mount being configured to hold the displacement body, when inserted into the tube, in a spaced relationship to the inner surface of the tube, wherein the mount comprises a plurality of support members radially extending from the surface of the displacement body, wherein the support members each have a recess at the side which is to face the heat exchanger tube, the recesses being configured to mate with the wall of the heat exchanger tube.

2. The anti-fouling device according to claim 1, wherein the mount is configured to arrange the longitudinal axis of the displacement body substantially parallel to the main axis of the tube.

3. The anti-fouling device according to claim 1, wherein the displacement body creates an annular gap between the outer surface of the displacement body and the inner wall of the tube in the mounted state, and/or wherein the displacement body has a shape, which is rotationally symmetric with respect to its longitudinal axis, and/or wherein the hollow body optionally has a through hole for pressure equalisation.

4. The anti-fouling device according to claim 1, further comprising one or more than one spacer on the surface of the displacement body.

5. The anti-fouling device according to claim 1, wherein the displacement body, the mount and/or the spacer(s) is/are made from stainless steel, and/or wherein the displacement body has a length in the range from 0.5 to 5 m and/or a cross-section of up to 20 cm.

6. A heat exchanger, comprising:

(a) at least one tube having a first end as inlet for a process medium and a second end as outlet for the process medium;

(b) a shell through which the at least one tube extends, the shell forming a plenum for a flow of a heat exchanging fluid from an inlet provided in the shell to an outlet provided in the shell enabling an exchange of heat between the process medium and the heat exchanging fluid across the at least one tube; and (c) an anti-fouling device as defined in claim 1 attached via the mount to one or more of the ends of at least one of the one or more tubes with the displacement body inserted in said tube in a spaced relationship to the inner surface of the tube to reduce the flow cross-sectional area in a portion of the tube.

7. The heat exchanger according to claim 6, wherein the flow cross-sectional area is reduced by the displacement body by from 10% up to 90% with respect to the flow cross-sectional area of the tube without inserted displacement body and/or wherein the displacement body extends over a length of up to 70% of the total length of the tube.

8. The heat exchanger according to claim 6, wherein the one or more than one tubes are arranged substantially vertically.

9. A method for reducing fouling on an inner surface of a heat exchanger tube through which a hot process gas entraining condensed phase matter is passed for exchanging heat with a heat exchanging fluid on the outside of the tube, the method comprising providing the heat exchanger tube with an anti-fouling device as defined in claim 1 attached via a mount to an end of the tube, with the displacement body inserted in said tube in a spaced relationship to the inner surface of the tube to reduce the flow cross-sectional area in a portion of the tube.

10. The method of claim 9, wherein the flow velocity of the process medium in the portion of the tube with the reduced flow cross-sectional is increased by the displacement body of the anti-fouling device to at least 50 m/s.

11. The method of claim 9, wherein the hot process gas entraining particulate matter is an effluent obtained from a reactor for the production of carbon black and/or has an initial temperature in the range from 400° C. to 1,200° C.

12. A process for manufacturing carbon black, comprising:

reacting a fuel with an oxidant to form a hot combustion gas, injecting a hydrocarbon feedstock in the hot combustion gas to form carbon black by pyrolysis of the feedstock in a reactor, quenching of the resulting carbon black containing process medium in the reactor, passing the quenched carbon black containing process medium through the one or more tubes of a heat exchanger according to claim 6, thereby transferring heat from the process medium to a heat exchange medium, and separating and collecting the carbon black from the cooled process medium having passed the heat exchanger.

13. A carbon black production plant comprising a combustion reactor and a heat exchanger according to claim 6.

14. A method for retrofitting a tubular heat exchanger comprising attaching a device according to claim 1 to the tubular heat exchanger.

15. The anti-fouling device according to claim 4, wherein the spacer(s) are arranged at or adjacent to the distal end of the displacement body with respect to the mount.

16. The anti-fouling device according to claim 4, wherein the spacer comprises a plurality of guiding fins radially extending from the surface of the displacement body, and the fins are dimensioned such as to increase the effective circumference of the displacement body by the fins to be in a range from 95 to 99.9% of the cross section of the heat exchanger tube.

17. The heat exchanger according to claim 8, wherein the at least one anti-fouling device is supported by the upper end of the respective tube to which it is attached via the mount and held in place by gravity.

* * * * *